United States Patent [19]

Hagler et al.

[11] Patent Number: 4,558,713

[45] Date of Patent: Dec. 17, 1985

[54] FRAME SYSTEM AND CONNECTORS FOR PORTABLE SHELTERS

[75] Inventors: Ernest Hagler, Denver; Charles A. Roose, Aurora; John B. Claypool, Denver, all of Colo.

[73] Assignee: American Canvas Company, Denver, Colo.

[21] Appl. No.: 437,878

[22] Filed: Oct. 29, 1982

[51] Int. Cl.[4] ..... A45F 1/16

[52] U.S. Cl. ..... 135/106; 135/109

[58] Field of Search ..... 135/106, 108, 101, 112; 403/49, 328, 329, 108, 237, 254, 316, 234, 100, 253, 407, 349, 173, 172, 9, 387, 344, 263, 219, 349, 350; 52/280

[56] References Cited

U.S. PATENT DOCUMENTS

| | | | |
|---|---|---|---|
| D. 176,504 | 1/1956 | Dous, Jr. | D88/3 |
| 2,144,747 | 1/1939 | Adams | 135/106 |
| 2,488,809 | 11/1949 | Denn | 135/3 |
| 2,527,256 | 10/1950 | Jackson | 403/349 |
| 2,711,180 | 6/1955 | Sims et al. | 135/3 |
| 2,757,677 | 8/1956 | Denn | 135/106 |
| 2,818,875 | 1/1958 | Denn | 135/3 |
| 2,836,860 | 6/1958 | Staropoli | 135/106 X |
| 2,839,320 | 6/1958 | Hill | 287/54 |
| 2,874,708 | 2/1959 | Dous, Jr. | 135/4 |
| 3,266,503 | 8/1966 | Hoiness et al. | 135/112 X |
| 3,424,178 | 1/1969 | Yazaki | 135/1 |
| 3,426,367 | 2/1969 | Bradford | 403/329 X |
| 3,448,748 | 6/1969 | Walrave | 135/106 X |
| 3,579,724 | 5/1971 | Toth | 18/4 |
| 3,625,235 | 12/1971 | Gorgichuk | 135/1 |
| 3,690,078 | 9/1972 | Maynard, Jr. | 135/106 X |
| 3,766,932 | 10/1973 | Sidis et al. | 135/4 R |
| 3,851,601 | 12/1974 | Davis | 403/171 X |
| 3,896,831 | 7/1975 | Feldman et al. | 135/3 R |
| 4,056,327 | 11/1977 | Daus, Jr. et al. | 403/172 |
| 4,074,682 | 2/1978 | Yoon | 135/109 |
| 4,077,417 | 3/1978 | Beavers | 135/3 R |
| 4,247,216 | 1/1981 | Pansini | 403/329 X |

FOREIGN PATENT DOCUMENTS

| | | | |
|---|---|---|---|
| 656903 | 12/1964 | Belgium | 403/328 |
| 1145807 | 10/1957 | France | 135/106 |

*Primary Examiner*—Robert A. Hafer
*Assistant Examiner*—Danton D. DeMille
*Attorney, Agent, or Firm*—John E. Reilly

[57] ABSTRACT

A frame assembly for a free-standing portable shelter comprises a plurality of tubular frame members releasably interconnected by a system of connector fittings. Leg and eave members are provided with spring-loaded projecting members which releasably engage corresponding apertures in unitary corner and eave fittings; rafter members include slotted locking collars connectable at one end to bar-type coupling means on eave and corner fittings, and at the other end to a central anchor member. Leg braces are mounted between leg and eave members by spring pins for additional support. The structure may be assembled and disassembled quickly and entirely without the use of tools.

15 Claims, 21 Drawing Figures

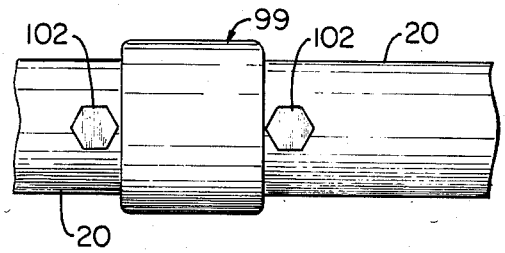
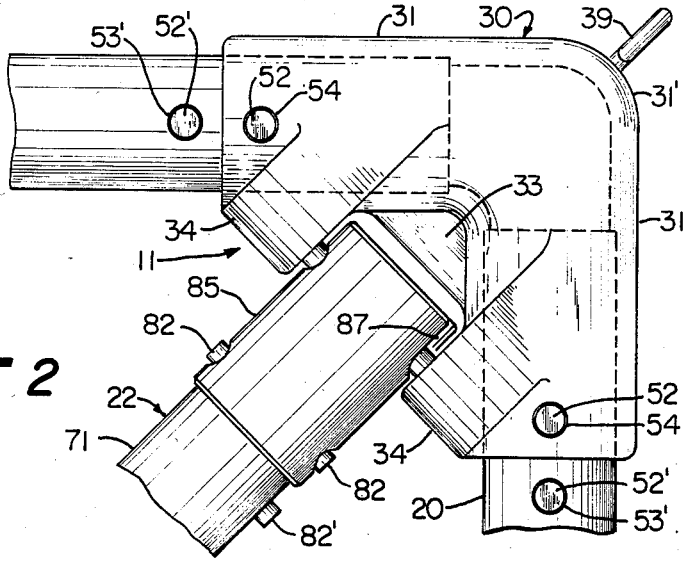
FIG. 2
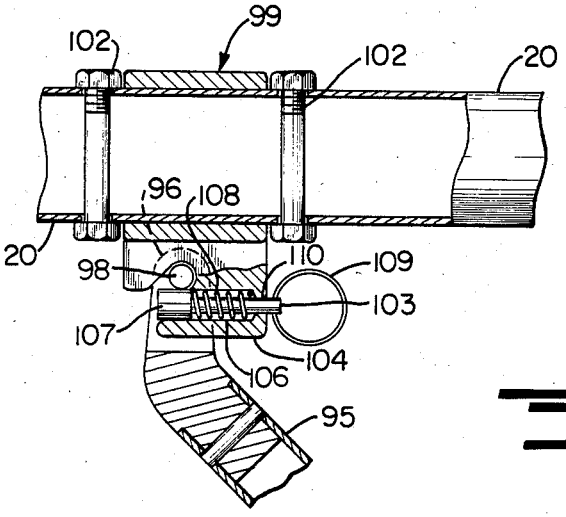
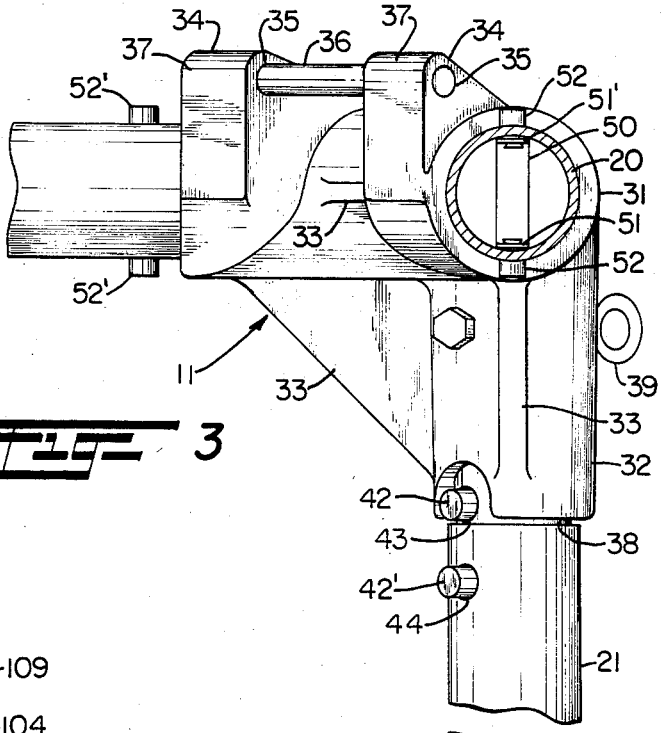
FIG. 3
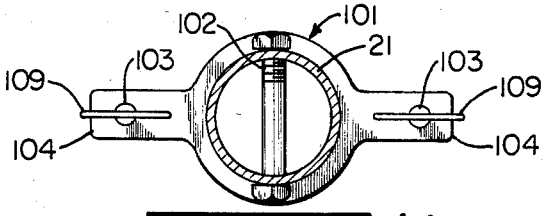
FIG. 11
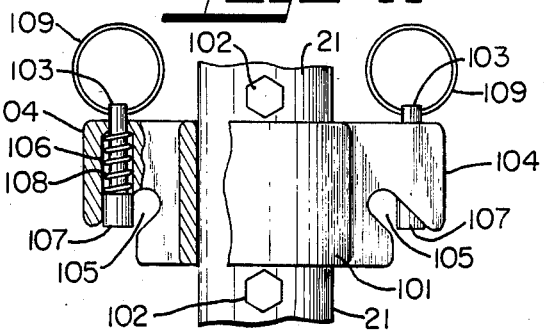
FIG. 10
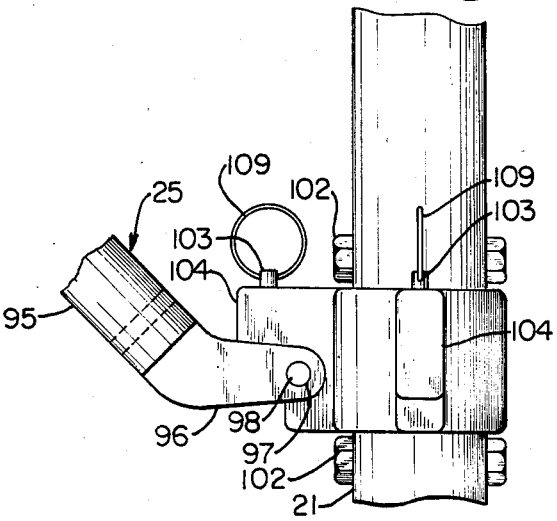

FRAME SYSTEM AND CONNECTORS FOR PORTABLE SHELTERS

This invention relates to portable shelters; and more particularly relates to a novel and improved frame construction for tents and the like which may be assembled and disassembled quickly without the use of tools.

BACKGROUND AND FIELD OF THE INVENTION

The prior art in the field of tents and temporary shelters yields a variety of tent frame assemblies suitable for use in widely different situations. The circumstances of intended use largely determine the structural features to be included in or eliminated from the tent design. For example, tents employed by backpackers should be of simple construction, preferably having lightweight components which may be connected without the need for tools or complicated hardware. Representative disclosures of this type of portable frame assembly include U.S. Pat. Nos. 2,757,677 to B. L. Denn; 3,625,235 to P. Gorgichuk and 4,077,417 to A. E. Beavers.

In contrast to the foregoing, tents to be used at carnivals or exhibitions are exposed to greater stresses over a longer period of time, but must nonetheless provide a stable shelter over a large area. Accordingly, frames for these tents generally feature heavier rigid struts or post members linked together by reinforced connecting means, such as, brackets or clamps secured with bolts or pins. Examples of these sturdier assemblies include the prefabricated enclosure disclosed in U.S. Pat. No. 2,711,180 to E. H. Sims et al as well as a corner connector for tent frames described in U.S. Pat. No. 4,056,327 to J. J. Daus, Jr. et al. In the past, the assembly procedure for larger structures has been complicated and time-consuming, usually requiring the use of wrenches, screwdrivers, mallets and the like. This disadvantage is reduced somewhat in frame arrangements provided with hand or thumbscrew connector means which eliminate the need for tools as in the tent frames referred to earlier. U.S. Pat. Nos. 2,144,747 to J. Q. Adams; 2,874,708 to J. J. Daus, Jr.; and 3,896,831 to B. L. Feldman et al teach variations of this approach. Although such simplified connecting devices represent improvements in the art, they do not offer significant time savings; each screw must be individually tightened during initial assembly, then retightened to insure stability. It is a further drawback that the small screws or nuts may become detached from the connector brackets and easily lost.

To date, there remains a need for a frame assembly which combines the advantages of both lightweight and heavier tents of the prior art: a simple design having relatively few components of extremely durable construction, and easily operated connector means enabling rapid assembly into a spacious stable tent without the need for tools of any kind. Tents so designed would have application in a wide variety of situations, such as, at fairs, receptions, displays and virtually any outdoor or indoor event requiring temporary shelters which can be easily set up and dismantled.

SUMMARY OF THE INVENTION

It is therefore an object of the present invention to provide for a novel and improved tent frame assembly having a system of connector means for uniting frame members into a coherent tent structure without the use of tools or additional hardware.

Another object of the present invention is to provide for a tent frame assembly that is capable of withstanding substantial stress such as would be imposed by severe winds, rain and other externally applied forces.

It is a further object to provide for a novel and improved tent assembly wherein the frame members have novel connector means thereon to permit rapid locking interconnection of the members with minimal physical effort.

It is a further object of the present invention to provide for a novel and improved tent frame assembly which is readily conformable to a wide variety of sizes and shapes, including gabled and lipped roof configurations, while having means obviating a center pole for even the largest structures.

It is an additional object of the present invention to provide a tent frame for fairs, exhibitions and the like which may be dismantled into manageable components for transportation to a desired site.

In accordance with the foregoing objects, the tent frame assembly of the present invention comprises a plurality of tubular frame members interconnected to form a coherent free-standing structure by means of a system of spring-mounted, unitary connector units of several configurations in combination with a bar-type coupling means and a central anchoring member. In the preferred embodiment of the invention, a free-standing structure having a hipped roof may be assembled without the need for a center pole; moreover, by varying the length of the frame members and the placement of the connector means, square or rectangular tents of different sizes can be constructed.

Tubular frame members including eave pole sections and legs are releasably coupled to appropriate four-way corner and mid-eave socketed fittings by means of generally U-shaped, compressible leaf springs disposed within the opposite ends of each tubular member and biased to bear against the interior wall thereof. Projecting members on the compressible spring means extend through corresponding openings in the walls of the frame member and the sleeve of the corner or mid-eave fitting so that the frame member is releasably retained within the fitting. Rafter members, comprising corner rafters and mid-eave rafters, are provided with collar fittings spring-mounted in the above-mentioned manner at either end thereof. Each rafter end fitting is further provided with a pair of notches adapted for releasable locking engagement at the upper end with one side of an octagonal anchoring ring or central crown casting, and at the lower end with a bar-type coupling member on the corner or the mid-eave connector fitting. The corner rafter members are supported on either side by diagonally extending rafter braces provided with notched end fittings as hereinbefore described. At their lower ends, the diagonal braces engage the bar coupling member on the mid-eave fitting; and the upper end fittings are joined to bar-type coupling means located intermediately on the corner rafter members.

In an alternate embodiment of the present invention, a gabled roof may be obtained by altering the configuration of the bar-type coupling members on the corner connector fittings so that the rafter members will lie in the appropriate plane. A pair of rectangular anchor members at opposite ends of a horizontal ridge pole replaces the octagonal crown assembly; the rectangular anchors are connected to the rafters by means of spring-mounted fittings of suitable configuration.

Other objects, advantages and features of the present invention will become more readily appreciated and understood when taken together with the following detailed description in conjunction with the accompanying drawings, in which:

BRIEF DESCRIPTION OF THE DRAWINGS

FIG. 2 is a top plan view enlarged of a preferred form of corner connector unit in accordance with the present invention;

FIG. 3 is a side view partially in section of the corner connector unit shown in FIG. 2;

FIG. 10 is a view partially in section of a portion of the diagonal brace assembly in accordance with the present invention;

FIG. 11 is a cross-sectional view of the portion of the diagonal brace illustrated in FIG. 10;

DETAILED DESCRIPTION OF THE PREFERRED EMBODIMENT

Figure 1:
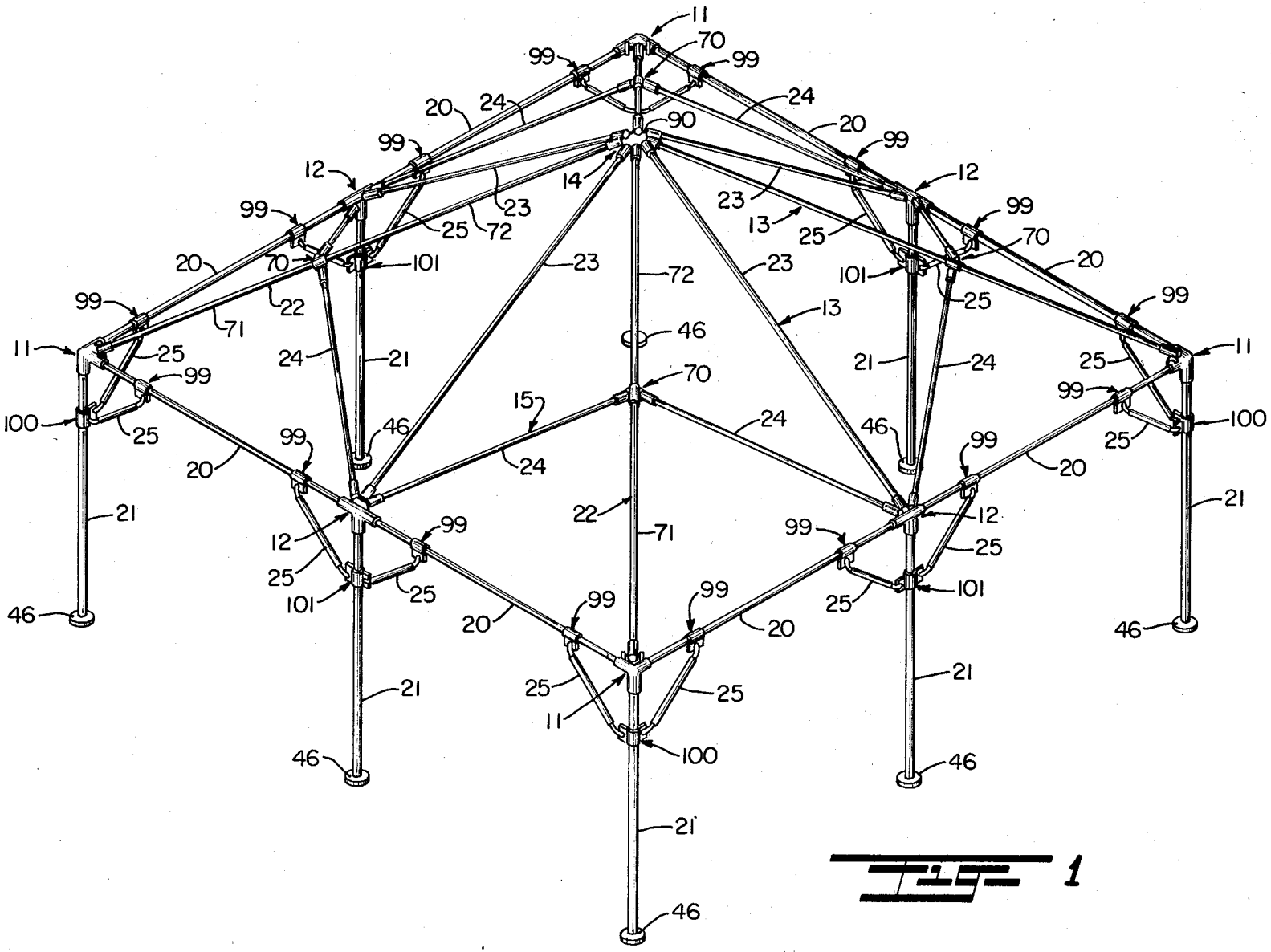
FIG. 1 is a perspective of a preferred form of frame system for portable shelters in accordance with the present invention.

Referring in more detail to the drawings, and in particular to FIG. 1, the tent frame assembly 10 of the present invention is comprised of a plurality of tubular frame members interconnected by a system of novel connector fittings into a large yet stable structure. Tent frame assembly 10 is most clearly defined by a consideration of the cooperation of fittings and frame members at major points of connection, specifically corner assembly 11, intermediate eave assembly 12, rafter assembly 13, crown assembly 14 and rafter brace assembly 15. As will be described hereinbelow in greater detail, the connector assemblies unite an arrangement of tubular frame members including eave poles 20, legs 21, corner rafters 22, intermediate rafters 23, and rafter braces 24. In addition, legs 21 are braced against swaying and lateral shifting by means of diagonal braces 25.

The corner assembly 11 illustrated in detail in FIGS. 2 and 3 is a four-way connector unit rigidly yet releasably interconnecting the upper end of a tent leg 21 and the ends of two eave poles 20 at a common corner, and having means for adjustably anchoring a corner rafter 22 thereto so that the pitch of the roof may be varied to accommodate different tent configurations and sizes. Corner assembly 11 includes a frame member-receiving corner fitting 30 cast in a modified tee configuration in which the upper cross member of the tee forms horizontally directed, right angle socket members or sleeves 31 perpendicular to one another and to a vertical socket end 32 extending downwardly from the juncture 31' of horizontal socket 31. Vertical and horizontal reinforcing plates 33 of generally triangular configuration span the angled spaces formed between horizontal sockets 31 and vertical socket 32, respectively. A pair of generally triangular end supports 34 project upwardly and angle slightly inwardly from either side of the juncture 31' of horizontal sockets 31, and are provided with aligned apertures 35 adapted to receive and tightly retain opposite ends of a rafter anchor pin 36 inserted therethrough. It will be noted that apertures 35 are disposed near the apices 37 of triangular supports 34 so that the rafter anchor pins 36 span the tent corner in a plane slightly above the horizontal sockets 31.

Figure 15:
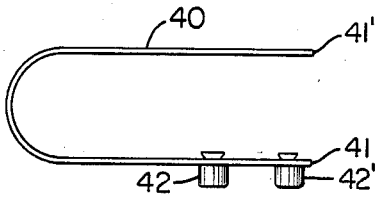
FIG. 15 is a front view of a two-button spring connector employed in accordance with the present invention.
Figure 17:
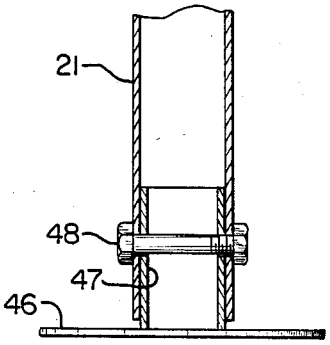
FIG. 17 is a cross-sectional view illustrating the base support for the vertical legs of the frame system.

The lower end of vertical socket 32 receives an inner tubular support member 38 disposed concentrically therein and is permanently retained by an eyebolt 39 or similar fastening means. Inner tubular member 38 in turn is insertable into concentric alignment within a leg 21 and is retained therein by releasable coupling means comprising a U-shaped leaf spring 40 provided with projecting members thereon, illustrated in detail in FIG. 15. The spring 40 is disposed within tubular support member 38 so that its free ends 41, 41' are biased outwardly against the interior wall thereof and its common closed end extends upwardly toward corner fitting 30. Free end 41 of U-spring 40 is provided with a first button 42 projecting through a first circular aperture 43 in inner tubular member 38, and a second button 42' projecting through a second aperture 43'. Preferably, the buttons 42, 42' are of cylindrical configuration having flattened end surfaces. U-spring 40 is sufficiently flexible that when pressure is applied against button 42, button 42' will be depressed into aperture 43' so as to be substantially flush with the exterior surface of inner tubular member 38; the tubular member 38 is then inserted into concentric relation within a tent leg 21 and advanced until upper end of leg 21 abuts the lower end of vertical socket 32. Upon release of pressure applied to button 42, button 42' will spring outwardly through aperture 43' and through a corresponding circular aperture 44 in the upper end of leg 21, thereby releasably retaining the leg 21 in proper alignment to the corner fitting 30. A generally disk-shaped foot member 46 illustrated in FIG. 17 is provided with an upwardly directed cylindrical member 47 for insertion into the lower end of each leg 21 and secured therein by bolt 48.

Figure 12:
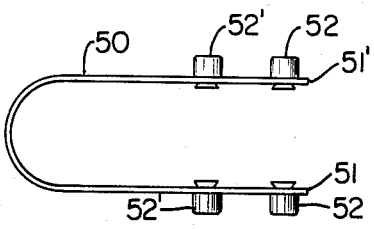
FIG. 12 is a front view in detail of a four-button spring connector employed in the assembly of the present invention.
Figure 13:
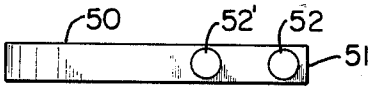
FIG. 13 is a side view of the spring connector shown in FIG. 12.

The eave poles 20 may be correspondingly provided at each end with U-shaped springs 50, as illustrated in detail in FIGS. 12 and 13, having free ends 51, 51' bearing against diametrically opposed points on the inner wall of eave pole 20. A first pair of aligned, outwardly facing buttons 52 is mounted near the termini of free ends 51, 51'; a second pair of outwardly facing buttons 52' is spaced therefrom in the direction of the closed end of the spring 50. Buttons 52 each project through aligned, diametrically opposed apertures 53 in eave pole 20, while buttons 52 on free ends 51, 51' extend through corresponding apertures 53'. Each horizontal sleeve 31 of corner fitting 30 is provided with diametrically opposed circular apertures 54 adapted to receive buttons 52. Interconnection of each of the eave poles 20 and horizontal sockets 31 is accomplished by depressing buttons 52' and slidably advancing each eave pole 20 into the socket defined within horizontal sleeve 31 until buttons 52 align with apertures 54, then releasing buttons 52 so that eave pole 20 is retained within horizontal socket 31 in the manner set forth above. Alternatively, eave poles 20 may be fastened within horizontal sockets 31 by bolts or other suitable means.

Figure 4:
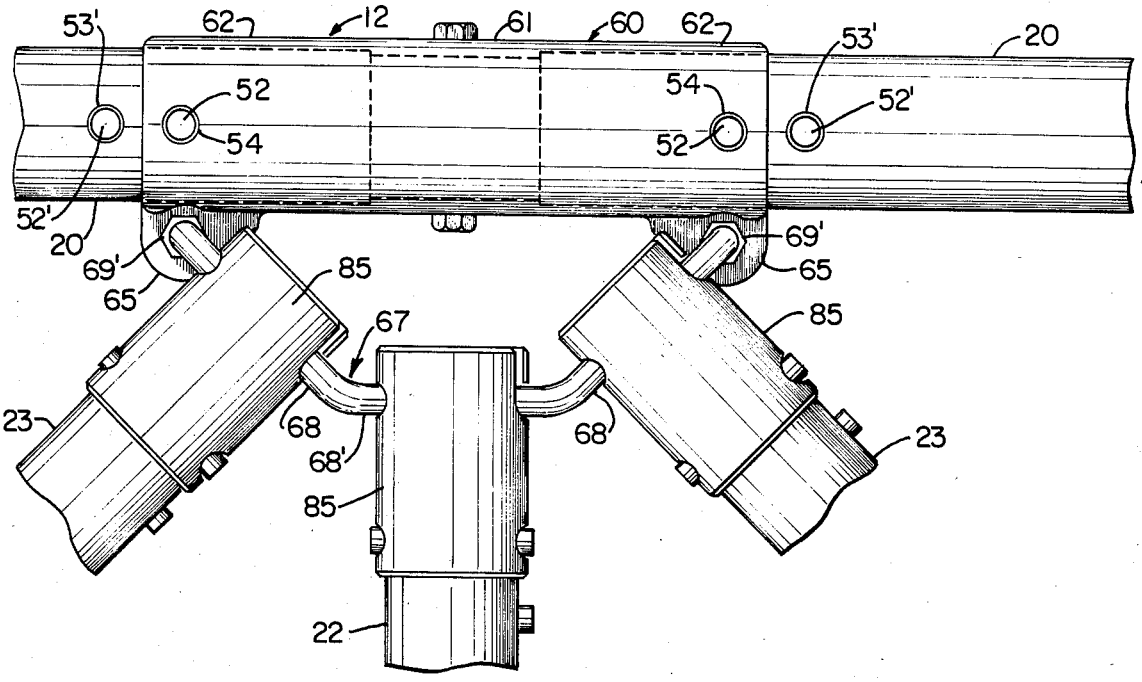
FIG. 4 is top plan view of a preferred form of intermediate connector unit.
Figure 5:
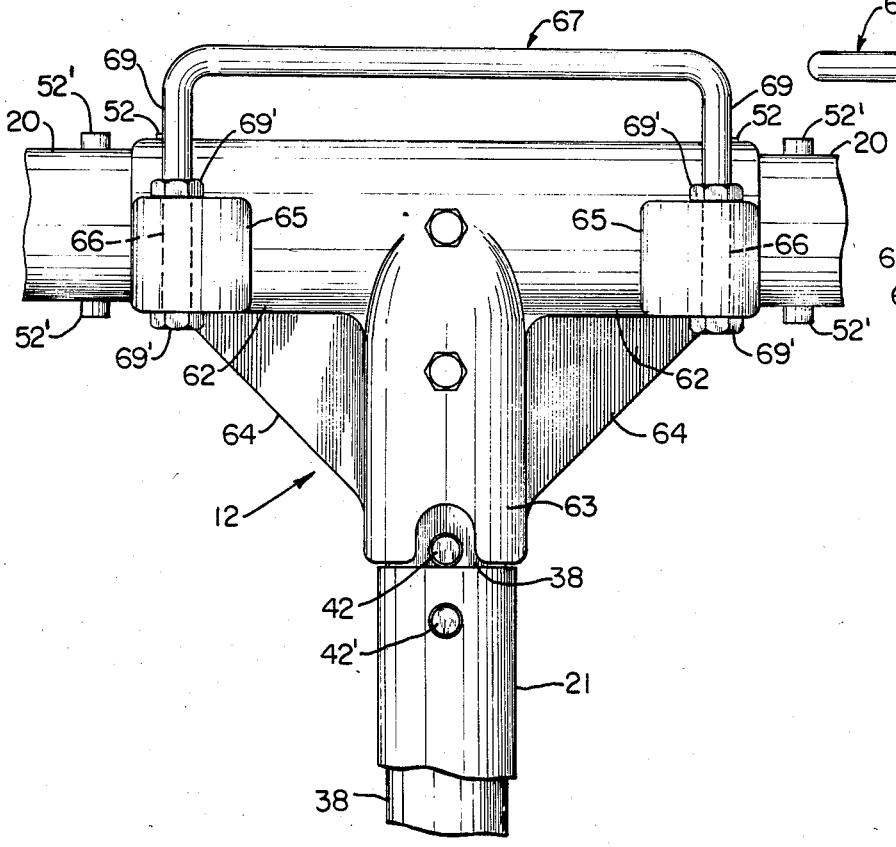
FIG. 5 is a front view in elevation of the preferred form of intermediate connector unit shown in FIG. 4.
Figure 6:
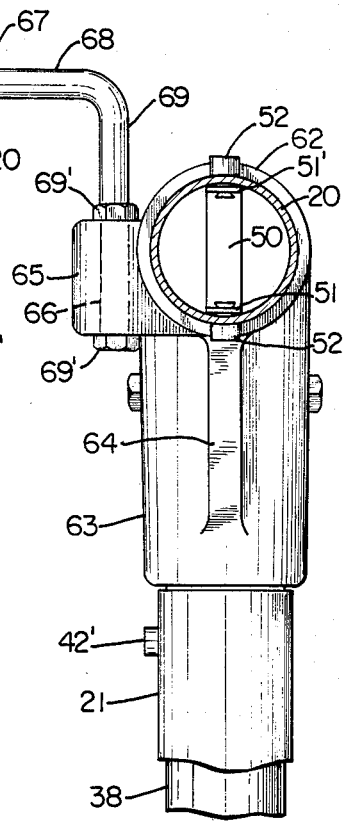
FIG. 6 is a side view partially in section of the intermediate corner unit shown in FIGS. 4 and 5.

Eave connector assemblies 12 are disposed intermediate the corner connector assemblies 11 and are adapted to releasably unite two or more eave poles 20 in end-to-end relation to one another to form the sides of a larger tent, and to releasably connect a leg 21 to the approximate midpoint thereof. Eave assembly 12 is further provided with a coupling member for adjustably anchoring rafter members 23 and diagonal braces 24 to create a roof of desired height and pitch. Corner assembly 11 and intermediate eave assembly 12 share common essential elements, differing primarily in the configuration of sleeve fittings. With reference to FIGS. 4 to 6, eave fitting 60 is generally T-shaped having a horizontally directed, hollow cylindrical body 61, the ends thereof forming horizontal sleeves 62 defining sockets adapted to receive an eave pole 20 therein. A downwardly directed vertical socket 63 is perpendicularly disposed with respect to cylindrical body 61, approximately intermediate the ends of sleeves 62. A reinforcing plate 64 spans the angle formed between horizontal sleeves 62 and vertical socket 63. A pair of lugs 65 are disposed at the ends of horizontal sleeves 62 and project inwardly toward the interior of the tent frame assembly 10. The lugs 65 are provided with apertures 66 receiving a diagonal rafter anchor bar 67 projecting upwardly therefrom. Anchor bar 67 is semi-hexagonal in configuration and circular in cross-section, and is comprised of a pair of diagonal segments 68 joined by an intermediate straight segment 68'. Diagonal segments 68 are bent downwardly at an angle of 90° to form vertical legs 69 which are insertable into the apertures 65 and secured therein by nuts 69' or the like. An inner tubular member 38 is received in inner concentric relation within the lower end of vertical socket 63 as disclosed above with reference to corner assembly 11. The legs 21 and eave poles 20 are installed in a like manner.

Figure 8:
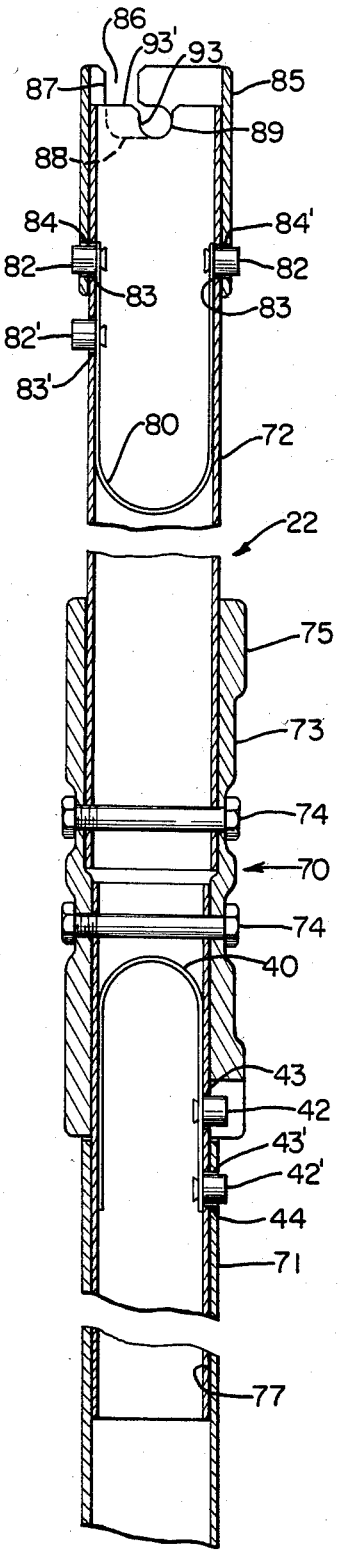
FIG. 8 is side elevational view of a rafter pole assembly as shown in FIG. 7.
Figure 7:
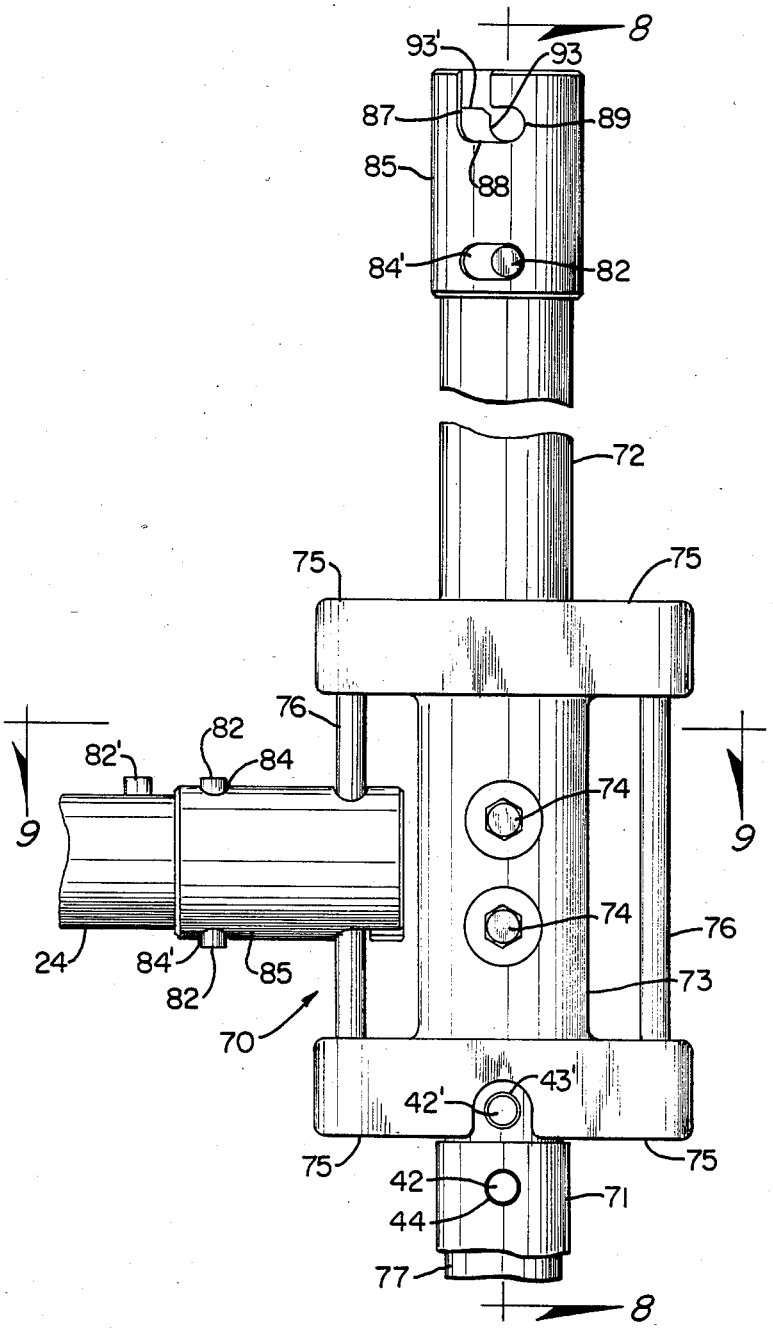
FIG. 7 is a longitudinal sectional view of a preferred form of rafter pole assembly in accordance with the present invention.
Figure 14:
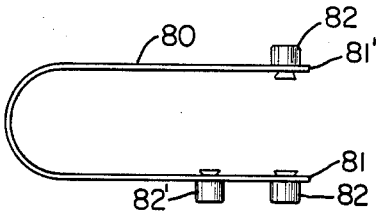
FIG. 14 is a front view in detail of a three-button spring connector employed in accordance with the present invention.
Figure 16:
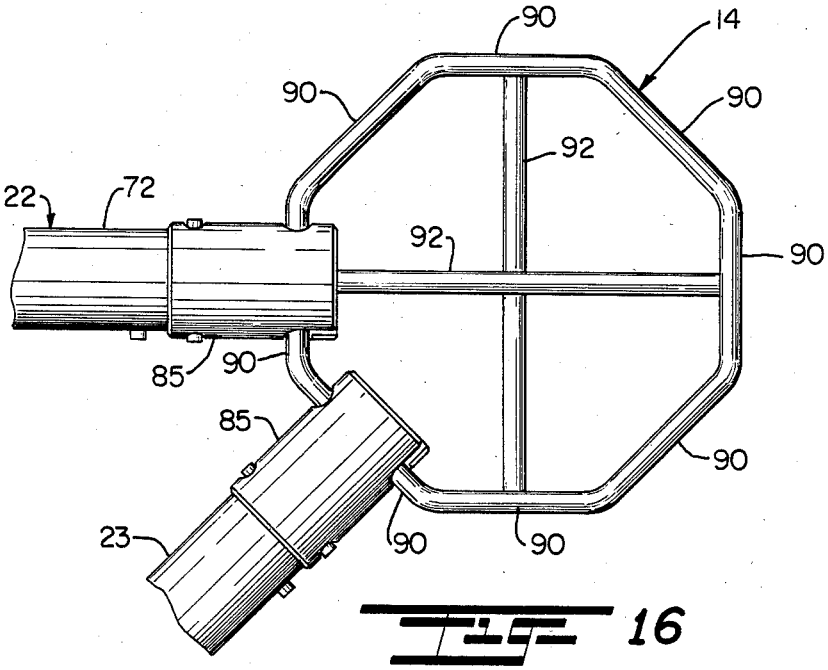
FIG. 16 is a top plan view of a preferred form of rafter crown connector illustrating the connection of a pair of upper rafter poles to the crown connector.

In the rectangular tent of the preferred embodiment, rafter assembly 13 comprises corner rafters 22 and intermediate rafters 23 releasably joined at their respective lower ends to corner and eave connector assemblies 11 and 12, and at their upper ends to a central crown anchor member 14 shown in FIG. 16. With reference to FIGS. 7 and 8, corner and intermediate rafters 22, 23 are provided at opposite ends with a pair of diametrically opposed open slots or notches 93 which cooperate with open slots 86 on attached locking collars 85 to engage the aforesaid connector units 11, 12, 14 in a manner to be hereinafter described. Locking collars 85 are fastened in outer concentric relation to opposite ends of rafters 22, 23 by a three-button U-spring 80 illustrated in detail in FIG. 14. As in the four-button spring 50, a pair of aligned, oppositely directed buttons 82 are mounted near free ends 81, 81' of the spring 80; however, only one free end 81 is provided with a second radially outwardly directed button 82' spaced inwardly toward the closed end from button 82. Buttons 82 project through apertures 83 in the upper and lower ends of the rafters 22, 23 and through apertures 84, 84' in one end of a tubular locking collar 85, one of the apertures 84' being elongated in a circumferential direction, as shown in FIG. 8. Button 82' projects through aperture 83' in the rafter tube wall beyond the inner end of the collar 85 so that it can be fully depressed to cause button 82 to clear the aperture 84 and permit rotation of the locking collar 85. The opposite or outer end of locking collar 85 is provided with diametrically opposed, generally L-shaped, open slots 86 adapted to receive an appropriate anchor pin on corner and eave fittings 30, 60. When locking collar 85 is in locked position on the rafter end, L-shaped slots 86 are normally out of alignment with the open notches 93 so that corners 93' of notches 93 project into the axially directed portions 87 of slots 86 and effectively form a closed slot in the horizontal portion 88 thereof. Corner rafter 22 is releasably connected to corner anchor bar 36 by depressing button 82' so that button 82 clears aperture 83, then rotating locking collar 85 slightly until slots 93, 86 are in axial alignment. Corner rafter 22 is then oriented so that slots 86 of the lower locking collar 85 are aligned with anchor bar 36, whereupon corner rafter 22 is advanced so that anchor bar 36 is slidably received in axially directed portions 87 of slots 86; the locking collar 85 is then rotated to return slots 93, 86 to normal, unaligned relation so that corners 93' project into the L-shaped slots 86 and anchor bar 36 is advanced against rounded inner edges 89 of horizontal portions 88. At this point, the button 82 will be aligned with aperture 84 so as to lock the collar 85 on the end of rafter 22. It will be evident that the anchor bar 36 is released by depressing the button 82' until the button 82 clears the aperture 84 and the collar 85 is then rotated until the anchor bar is able to move outwardly through the longitudinal slotted portions 87. Intermediate rafters 23 are similarly joined to the eave fitting 60 by latching the locking collar 85 to the intermediate straight segment 68' of semi-hexagonal anchor bar 67.

At the upper ends of rafters 22, 23 locking collars 85 are connected in a like manner to the crown member 14 composed of an octagonal array of anchor bars 90 connected in end-to-end relation. The anchor bars 90 are reinforced by a pair of perpendicular cross bars 92 and affixed at opposite ends to anchor bars 90. Upper ends of each corner rafter 22 are latched by the locking collars 85 to alternate bars 90, as illustrated in FIG. 16, while upper ends of intermediate rafters 23 are connectable with remaining alternate bars 90.

The corner and intermediate rafters 22, 23 may comprise single tubular members from eave to crown; however, in larger tents as shown in FIG. 1 it is desirable to form the corner rafter 22 from lower and upper rafter tubes 71, 72 joined in end-to-end relation to one another by a rafter fitting 70, and supported at either end by diagonal rafter brace assemblies generally designated at 15. Referring to FIGS. 7 and 8, the rafter fitting 70 comprises a cylindrical body 73 insertable over the lower end of upper rafter tube 72 and secured thereto by bolts 74. An inner tubular support member 77 received in the lower end of cylindrical body member 73 is retained therein by the lower bolt 74, and is provided with a two-button U-spring connector 40 which engages the upper end of lower rafter tube 71 in the manner previously disclosed. Cylindrical body 73 is provided at each of its upper and lower ends with a pair of oppositely directed lug members 75 having aligned apertures, not shown, for receiving a pair of anchor bars 76 therein in parallel, spaced-apart relation to cylindrical portion 73.

The rafter brace assembly 15 comprises a plurality of tubular rafter braces 24 fitted with slotted locking collars 85 and extending from intermediate eave fittings 60 to rafter fittings 70, as shown in FIGS. 1, 4 and 8. At their lower ends rafter braces 24 are releasably secured to the eave fitting 60 at one of the diagonal segments 68 of semi-hexagonal anchor 67 in the manner previously recited. Upper ends of the braces 24 are similarly connected to the rafter fitting at one of the anchor bars 76.

Additional bracing means 25 are provided at eave corner and eave assembly 11, 12 to stabilize the rigid interconnections effected between eaves 20 and legs 21. Referring to FIGS. 1 and 3, a tubular brace 95 diagonally spans the angled space between eave pole 20 and leg 21 at corners and mid-eave junctures. The braces 95 are provided at each end with a pair of tabs 96 angled at approximately 120° with respect to the brace body and having aligned apertures 97 receiving a transversely extending pin 98. In the corner assembly 11 of FIG. 3, the brace 95 is releasably connected at its upper end to an eave sleeve 99 and at its lower ends to a corner leg sleeve 100; at mid-eave junctures the lower end of the brace 95 is received in the intermediate leg sleeve 101 shown in detail in FIGS. 10 and 11. The sleeves 99, 100, 101 are identical in essential structure and function, being disposed in outer concentric relation to respective eave poles 20 and legs 21 and held in place between a pair of positioning bolts 102, and further including spring-loaded pins 103 adapted to releasably engage transverse pins 98 of braces 95. With specific reference to FIGS. 10 and 11 illustrating the intermediate leg sleeve 101 employed in connection with eave assembly 12, sleeve 101 has a pair of oppositely directed extension wings 104 with angled notches 105 formed therein to receive transverse pins 98. Pins 103 in sleeves 99, 100, 101 are retained for slidable movement within channels 106 extending through extension members and communicating with notches 105. Pins 103 include enlarged end portions 107 and are biased by coil springs 108 so that the enlarged ends 107 normally project a limited distance into notches 105 to effectively reduce or obstruct the opening thereof thereby acting to hold transverse pin 98 within the notch 105 and support brace 95 in position. Accordingly, to remove the braces 95 from the connector sleeves 99, 100, 101, the spring pin 103 is grasped at ring 109 and pulled against the bias of spring 108 until enlarged end portion 107 is retracted into channel 106 and transverse pin 98 is released. It will be noted that channel 106 is provided with a narrow neck portion 110 which serves as a limit stop to prevent pin 103 from being completely withdrawn from channel 106.

The leg braces 95 in corner positions require a mounting sleeve slightly different from the intermediate leg sleeve 101. Specifically in the sleeve 100 shown in FIG. 3, extension members 104 are set at right angles to one another, rather than extending in opposite directions. Eave sleeves 99 connecting the upper ends of braces 95 are provided with a single, downwardly directed extension member 104, but are in other respects identical to the sleeves 100, 101.

DETAILED DESCRIPTION OF ALTERNATE EMBODIMENT OF THE PRESENT INVENTION

Figure 18:
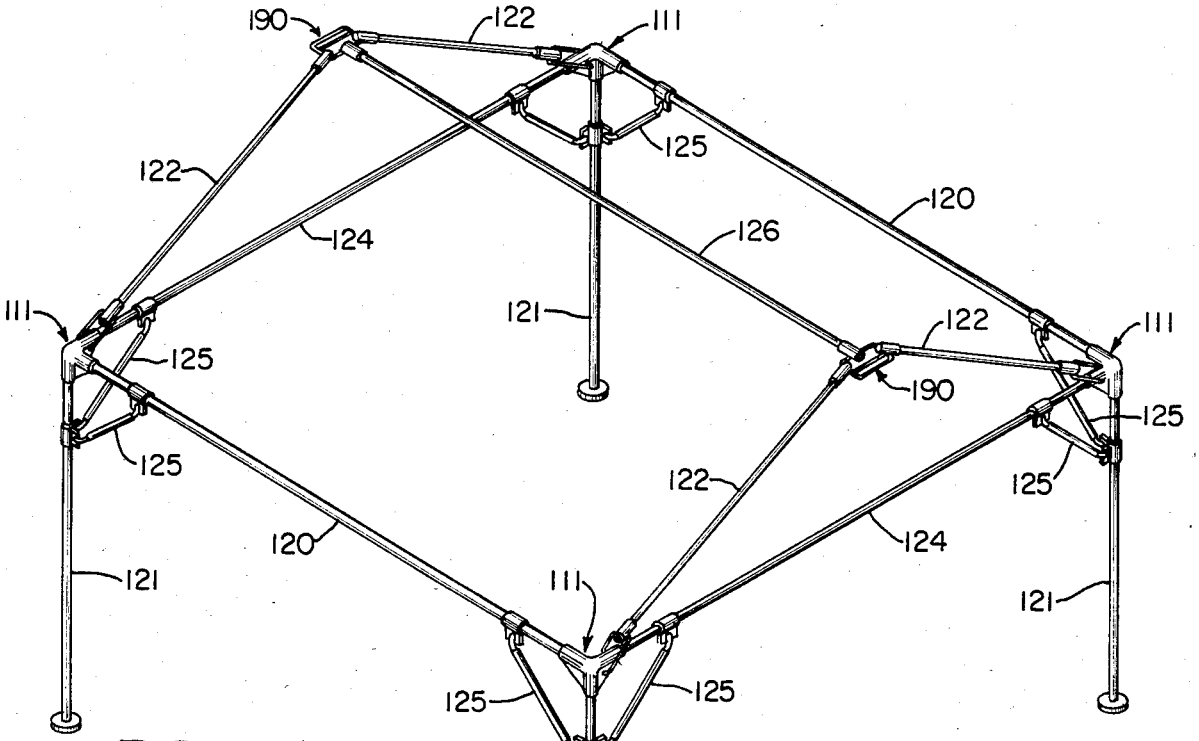
FIG. 18 is a perspective of an alternate embodiment of the present invention.
Figure 20:
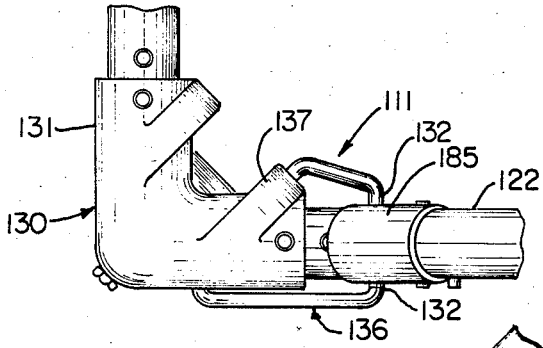
FIG. 20 is a top plan view of the modified form of connector shown in FIG. 19.
Figure 19:
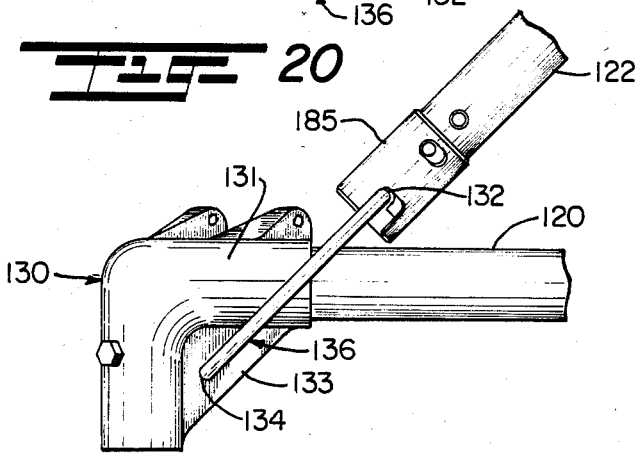
FIG. 19 is a side view enlarged of a modified form of corner connector employed in the alternate embodiment shown in FIG. 18.

An alternate embodiment of the present invention is illustrated in FIGS. 18–20 and includes modified anchoring means permitting construction of a gabled roof. The essential structure of the alternate assembly is similar to that of the preferred embodiment wherein leg, eave and rafter members are releasably yet rigidly connected into a frame of desired size. The gabled roof arrangement is adaptable for a square or rectangular tent comprising leg members 121, side eaves 120, end eaves 124, rafters 122 and a horizontal ridge pole 126. Diagonal leg braces 125 of the type employed in the preferred embodiment may also be included, so will not be described in detail herein. Corner connector unit 111 is similar to connector 11 previously described, but is provided with a unique anchor bar 136 adapted to support rafters 122 in angularly adjustable gabled configuration. Specifically, the anchor means comprises a generally U-shaped bar 136 disposed generally above one of the horizontal sleeves 131. The bar 136 is threadedly received at one end thereof in an aperture 134 in triangular reinforcing plate 133 and is first bent in an upward diagonal direction, then horizontally toward sleeve 131 to form a segment 132, then diagonally downward to terminate in an end which is bent inwardly for insertion into an aperture, not shown, in the inclined face of support block 137. As in the arrangement of the preferred embodiment, the rafters 122 are fitted at either end with slotted locking collars 185. In turn, collars 185 at the lower ends of the rafters 122 are engageable with the segment 132 above horizontal sleeve 131 in the manner previously described.

Figure 9:
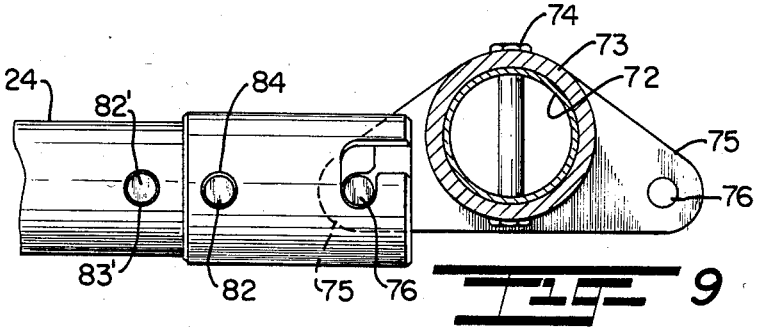
FIG. 9 is a cross-sectional view taken about lines 9—9 of FIG. 8.
Figure 21:
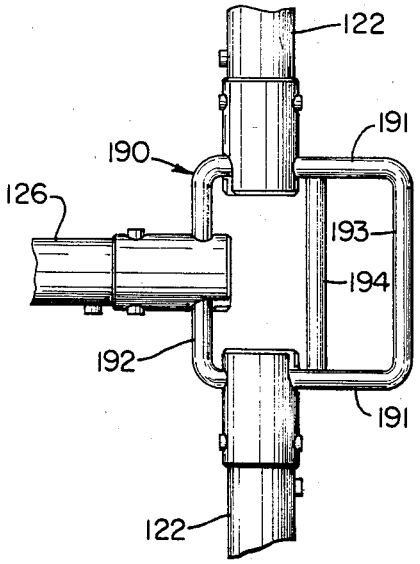
FIG. 21 is a top plan view of a modified form of rafter end connector employed in the alternate embodiment shown in FIG. 18 and illustrating the connection of a pair of rafter poles and a ridgepole to the end connector.

FIG. 21 illustrates the generally rectangular end anchor member 190 having opposite rafter-receiving sides 191 and opposite sides 192, 193, side 192 being adapted to receive horizontal ridgepole 126 and a transverse reinforcing bar 194 parallel to sides 192, 193. Rafters 122 extend upwardly from corner units 111 in vertical alignment to end eaves 124 and are fastened by means of locking collars 185 to opposite sides 191 of anchor member 190. The horizontal ridgepole is similarly provided with locking collars 185 at opposite ends, and is similarly engageable with inwardly facing sides 192 of end anchors 190 at the front and rear of the tent assembly as illustrated in FIG. 18. Ridgepole 126 may be a unitary member or may comprise two or more tubular members joined in end-to-end relation by a fitting similar to rafter fitting 70 in FIGS. 7 to 9, having anchor bars adapted to receive brace members extending from appropriate connector units on side eaves 120. Further modification may be effected by varying the length of the rafter members to create a higher or lower roof since the pivotal interconnection between locking collars 185 and anchor members 136, 190 permits some degree of angular adjustment to rafters 122.

The construction procedure for the present invention clearly illustrates the particular advantages to be derived from the unique cooperation of elements in the improved frame structure. In assembling a square or rectangular tent of the type illustrated in FIG. 1, the entire eave portion is assembled to define the perimeter of the finished tent. Beginning at a first corner assembly 11, a first eave pole 20 is inserted into one horizontal sleeve 31 by compressing opposite spring-loaded buttons 52' on the releasable coupling means, then sliding eave pole 20 into sleeve 31 until buttons 52 align with apertures 54 in the sleeve 31, and finally releasing buttons 52' to "lock" the eave pole 20 in place within the sleeve. In the same manner, the opposite end of eave pole 20 is inserted and secured in the near horizontal sleeve of a first eave assembly 12. The far horizontal sleeve 61 thereof receives one end of a second eave pole 20, and the opposite end of the second pole 20 is received in a horizontal sleeve 31 of a second corner assembly 11, thereby forming one side of the frame assembly 10. A second side is begun perpendicular to the first by inserting one end of a third eave pole 20 into the remaining horizontal socket 31 on the second corner assembly 11, and the steps repeated until a perimeter of the desired size and shape has been completed. Additional eave assemblies 12 may be employed between corners to obtain longer sides.

At this point, if any additional roof support is required, lower and upper rafter tubes 71, 72 are joined into a uniform corner rafter 23 by rafter fitting 70; each corner rafter is then connected to corner fittings 30 by aligning the locking collars 85 with anchor pins 36, then twisting collars 85 so that anchor pin 36 is seated securely within the notch. Locking collars 85 are most conveniently installed at opposite ends of rafters 22, 23 at the time of manufacture and need not be removed during dismantling of the frame assembly. Intermediate rafters 22 are connected by similar spring-loaded coupling means to the central anchor segment 68' on the eave fitting 60. When all rafters, such as, eight in the preferred embodiment, have been secured at their lower ends, each upper end is connected by twisting a locking collar 85 onto a side of the octagonal crown 14. If two-piece corner rafters have been employed, diagonally extending rafter braces 24 may be locked into place to further support the roof, attached at their upper ends to an anchor bar 76 on rafter fittings 70 and at their lower ends to diagonal segments 68 on eave anchor bar 67. A separate tent covering, not shown, of canvas, nylon or other durable material may be stretched over the completed roof portion; the covering may be provided with grommets at its corners adapted to fit over eyebolts 39 on the corner fitting 30, or may be secured to the frame by other means. Assembly is completed by raising one side of the frame so that the inner tubular support members 38 on corner and eave fittings 30, 60 may be slidably inserted into legs 21, and spring-loaded buttons 42, 42' manipulated to retain the frame members in interconnected relation.

In order to prevent the tent from swaying or shifting, diagonal braces 95 are fastened at either side of each leg 21 by first aligning the brace so that transverse pins 98 are positioned at the outer openings of notches 105 on eave and leg mounting sleeves 99 and 100 or 101, then applying pressure to brace 95 so that transverse pins 98 bear against the ends 107 of spring-loaded pins 103 until transverse pins 98 are seated against the inner terminii of notches 105 and spring-loaded pins 103 are allowed to return to their normal position at the openings of notches 105.

Attachment of legs 21 and diagonal braces 95 is repeated for the remaining sides of the tent. At this time, the canvas covering may be adjusted as needed and securely strapped or otherwise fastened to the eave poles 20. As an additional precaution, it is recommended that guy ropes be attached to eyebolts 39 on corner fittings 30 and stretched to stakes driven into the ground.

A notable advantage of this invention resides in the ability to construct shelters of virtually any size or configuration, including rectangular or square, oblong and circular as well as various multi-sided polygonal configurations. The novel spring-loaded button couplings are readily adjustable for connecting frame members in any desired configuration, while the sleeves of the four-way connectors may be constructed to accept frame members in different angular orientations. Finally, since the combination of locking collars and bar-like anchor means permits pivotable and angularly adjustable connection of rafters at their upper and lower ends, it is possible to construct a tent roof of any desired pitch, size and configuration. For example, the basic structure of the square preferred embodiment can be modified to produce an oblong frame assembly of any desired proportions by incorporating additional crown anchor units 14. Two or more such units can be arranged horizontally having facing bar segments 90 thereon connected by a horizontal ridgepole and the remaining bars 90 receiving upper ends of rafter members. Accordingly, additional rafter braces may be included as required in larger, multiple-crown structures.

It is therefore to be understood that various modifications and changes may be made in the present invention without departing from the spirit and scope thereof as defined by the appended claims.

We claim:

1. In a frame assembly for a portable shelter wherein said frame assembly is provided with a vertical leg at spaced intervals, eave poles extending horizontally between upper ends of adjacent vertical legs, and rafter poles inclining upwardly from upper ends of said vertical legs for releasable interconnection to one another at a commom center, the improvement comprising:

a unitary four-way connector unit including a vertical leg-connecting socket member, a pair of horizontal eave pole-connecting socket members extending in substantially perpendicular relation to said leg-connecting socket member, and a rafter pole connector extending between said horizontal socket members;

first releasable coupling means between each of said socket members and adjoining ends of said vertical leg and eave pole members whereby to facilitate releasable connection therebetween without the use of tools, and second releasable coupling means between an end of each said rafter pole and each said rafter pole connector for angularly adjustable attachment of said rafter pole to said connector, said second releasable coupling means including opposed bayonet slots at said one end of said rafter pole, an anchor bar on said rafter pole connector insertable into said bayonet slots, and closure means normally retaining said anchor bar in closed ends of said slots; and a crown connector interconnecting upper ends of said rafter poles comprising a plurality of anchor bars joined in end-to-end relation to one another, longitudinally extending bayonet slots in each upper end of said rafter poles and spring-loaded closure means urged in a direction retaining one of said anchor bars in each of said slots.

2. In the frame assembly according to claim 1, each of said first releasable coupling means including a tubular support member retained in inner concentric relation to each of said socket members.

3. In the frame assembly according to claim 2, each said tubular support member including spring-loaded projecting members biased to project outwardly from said tubular support member into aligned apertures at the adjoining end of each of said leg and eave pole members.

4. In the frame assembly according to claim 3, each of said spring-loaded projecting members including a common leaf spring inserted into a tubular support member with said projecting members biased by said leaf spring outwardly through apertures in said tubular support member.

5. In the frame assembly according to claim 4, there being at least one projecting member on said leaf spring projecting through an aperture in said tubular support member and an aligned aperture in said connecting ends of said leg and eave pole members, and at least one additional projecting member projecting through an aperture in said tubular support member and through a recessed portion in said socket member.

6. In the frame assembly according to claim 1 wherein selected of said four-way connector units are corner connectors each having a vertical leg-receiving socket and horizontally extending eave pole-receiving sockets in perpendicular relation to one another and to said vertical leg-receiving socket.

7. In the frame assembly according to claim 1, each of said rafter poles including upper and lower rafter pole sections, and a connecting sleeve interconnecting said upper and lower rafter pole sections in end-to-end relation to one another.

8. In a generally rectangular frame assembly for a portable shelter having a pitched roof wherein said frame assembly is provided with a vertical leg at each corner, eave poles extending horizontally between upper ends of adjacent vertical legs, and corner rafter poles inclining upwardly from upper ends of said vertical legs at each corner and terminating in upper ends for releasable interconnection to one another at a common center, the improvement comprising:

a unitary four-way corner connector unit including a vertical leg-connecting socket, a pair of horizontal eave pole-connecting sockets, said sockets extending in substantially mutually perpendicular relation to one another, and a horizontally extending, rafter pole connector extending between said horizontal sockets; and first releasable coupling means between each of said sockets and adjoining ends of said vertical leg eave pole members whereby to facilitate releasable connection therebetween without the use of tools, and second releasable coupling means between an end of said corner rafter pole and said corner rafter pole connector for angularly adjustable attachment of said corner rafter pole to said corner connector, and a crown connector interconnecting upper ends of said corner rafter poles and comprising a plurality of anchor bars joined in end-to-end relation to one another, opposed bayonet slots in each upper end of said corner rafter, and spring-loaded closure means urged in a direction retaining said crow connector bar in each of said slots.

9. In the frame assembly according to claim 8, each of said first releasable coupling means including a tubular support member retained in inner concentric relation to each of said vertical leg-connecting sockets.

10. In the frame assembly according to claim 8, each said tubular support member and horizontal eave-connecting socket including spring-loaded buttons biased to project radially outwardly from said tubular support member and said eave-pole socket into aligned apertures at the connecting end of each of said leg and eave pole members.

11. In the frame assembly according to claim 10, each of said spring-loaded buttons including a common leaf spring inserted into a tubular support member with said buttons biased by said leaf spring outwardly through apertures in said tubular support member.

12. In the frame assembly according to claim 11, there being a pair of diametrically opposed buttons on said leaf spring projecting through apertures in said tubular support member and aligned apertures in said connecting ends of said leg and eave pole members, and an additional button projecting through an aperture in said tubular support member and through a recessed portion in said socket.

13. In the frame assembly according to claim 12, including intermediate four-way connector units each having a vertical leg-receiving socket and coaxial, horizontally extending eave pole-receiving sockets in perpendicular relation to said vertical leg-receiving socket, and first releasable coupling means between said sockets and connecting ends of said leg and eave pole members.

14. In the frame assembly according to claim 13, including intermediate rafter poles between adjacent corner rafter poles, releasable coupling means between said intermediate connector and a connecting end of each of said intermediate rafter poles, and diagonal brace poles between said intermediate connector and adjacent corner rafter poles.

15. In the frame assembly according to claim 14, each of said corner rafter poles including upper and lower rafter pole sections, and a connecting sleeve interconnecting said upper and lower rafter pole sections in end-to-end relation to one another, each of said diagonal braces releasably connected at opposite ends to said intermediate connector and said connecting sleeve.

* * * * *

UNITED STATES PATENT AND TRADEMARK OFFICE

CERTIFICATE OF CORRECTION

PATENT NO. : 4,558,713
DATED : 17 December, 1985
INVENTOR(S) : Hagler, E. et al

It is certified that error appears in the above—identified patent and that said Letters Patent is hereby corrected as shown below:

Column 5 Line 11 Cancel "termini" and substitute -- terminii --

Column 12 Line 12 Claim 8, cancel "crow" and substitute -- crown --

Column 12 Line 39 Claim 13, cancel "12" and substitute -- 8 --

Signed and Sealed this

*Twentieth* Day of *May 1986*

[SEAL]

*Attest:*

DONALD J. QUIGG

*Attesting Officer*

*Commissioner of Patents and Trademarks*